US006558186B1

(12) United States Patent
LePottier et al.

(10) Patent No.: US 6,558,186 B1
(45) Date of Patent: May 6, 2003

(54) KEYED CONNECTOR ASSEMBLY FOR FLAT FLEXIBLE CIRCUITRY

(75) Inventors: Yves LePottier, Grosse Pointe, MI (US); Robert M. Fuerst, West Bloomfield, MI (US); David A. Pfaffinger, Holly, MI (US); Jonathan D. Lohman, West Chicago, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/975,583

(22) Filed: Oct. 11, 2001

(51) Int. Cl.[7] ..... H01R 12/24

(52) U.S. Cl. ..... 439/496; 439/493; 439/680; 439/495

(58) Field of Search ..... 439/493, 495, 439/496, 680, 674, 677, 67

(56) References Cited

U.S. PATENT DOCUMENTS

| | | | | |
|---|---|---|---|---|
| 4,695,112 A | * | 9/1987 | Maston et al. | 439/680 |
| 5,277,591 A | * | 1/1994 | Felcman et al. | 439/680 |
| 5,403,202 A | * | 4/1995 | Roehling | 439/496 |
| 6,428,338 B1 | * | 8/2002 | Yasufuku et al. | 439/680 |

* cited by examiner

*Primary Examiner*—Tho D. Ta
(74) *Attorney, Agent, or Firm*—Stacey E. Caldwell

(57) ABSTRACT

A keying system is provided in a connector assembly for electrically interconnecting the conductors of a flat flexible circuit to the conductors of a complementary connecting device. The assembly includes a first connector having a body member for positioning the flat flexible circuit thereon. A second connector mates with the first connector and includes a pattern of keying projections insertable into a corresponding pattern of keying holes in the flat flexible circuit on the first connector.

6 Claims, 9 Drawing Sheets

KEYED CONNECTOR ASSEMBLY FOR FLAT FLEXIBLE CIRCUITRY

FIELD OF THE INVENTION

This invention generally relates to the art of electrical connectors and, particularly, to connectors for electrically interconnecting flat flexible circuitry.

BACKGROUND OF THE INVENTION

A flat flexible circuit conventionally includes an elongated flat flexible dielectric substrate having laterally spaced strips of conductors on one or both sides thereof. The conductors may be covered with a thin, flexible protective coating on one or both sides of the circuit. If protective layers are used, openings are formed therein to expose the underlying conductors at desired contact locations where the conductors are to engage the conductors of a complementary mating connecting device which may be a second flat flexible circuit, a printed circuit board or the discrete terminals of a mating connector.

A wide variety of connectors have been designed over the years for terminating or interconnecting flat flexible circuits with complementary mating connecting devices. However, problems still are encountered with such connectors when attempts are made to design the connectors with various desirable features. For instance, a known desirable feature in some electrical connector assemblies which include a pair of mating connectors, is to "key" the connectors so that only a given first connector can be mated with a given second connector. Such keying systems are difficult to achieve in connector assemblies for flat flexible circuitry, unless the keying features are added to the connector itself. In other words, a standard connector which accommodates a variety of flexible circuit configurations must be customized with the keying features alone, thereby increasing the cost of such connectors.

The present invention is directed to solving this problem by providing a unique keying system which uses the flat circuit, itself, as the means of providing keying features of the system.

SUMMARY OF THE INVENTION

An object, therefore, of the invention is to provide a new and improved connector assembly or system for electrically interconnecting the conductors of a flat flexible circuit to the conductors of a complementary connecting device, the connector system including keying features to prevent interchangeability of undesirable connectors in the assembly.

In the exemplary embodiment of the invention, a first connector has a body member for positioning the flat flexible circuit thereon. A second connector mates with the first connector and includes a pattern of keying projections insertable into a corresponding pattern of keying holes in the flat flexible circuit on the first connector.

According to one aspect of the invention, the body member of the first connector comprises a male body member having a leading edge at which the flat flexible circuit is positioned. The keying holes in the flat flexible circuit are located adjacent the edge. The circuit is wrapped about the leading edge of the male body member, and a plurality of recesses are formed in the leading edge behind the pre-positioned keying holes in the circuit so that the keying projections of the second connector can pass through the holes in the flexible circuit.

According to another aspect of the invention, the second connector includes a receptacle for receiving the first connector. The keying projections are located at the receptacle. The body member of the first connector comprises a male body member mateable in the receptacle of the second connector. Again, the flat flexible circuit is positioned at the leading edge of the male body member, with the keying holes in the circuit being located adjacent the edge.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENTS

Figure 1:
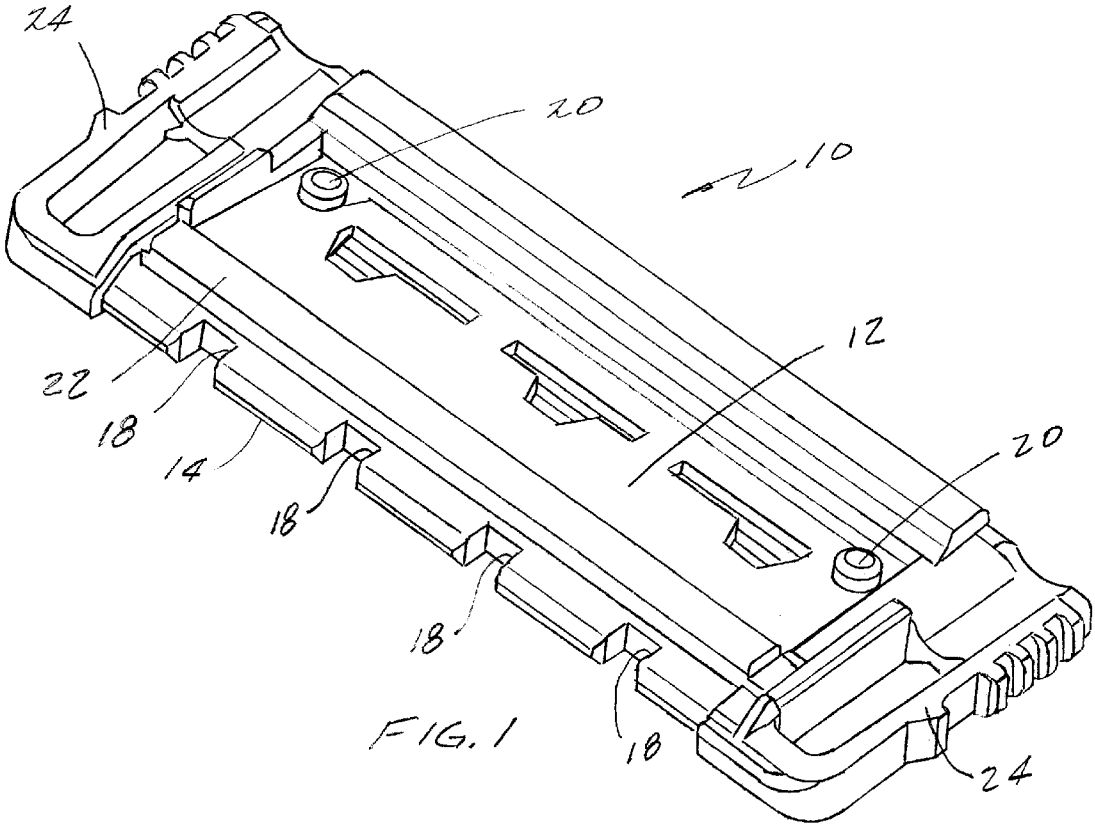
FIG. 1 is front perspective view of a male connector of a connector assembly according to a first embodiment of the invention.

Referring to the drawings in greater detail, FIGS. 1–10 show the components of an electrical connector assembly according to one embodiment of the invention, and FIGS. 11–18 show the components of an electrical connector assembly according to a second embodiment of the invention. Both connector assemblies incorporate the same general principles of the invention in that they have a keying system in a connector assembly for electrically interconnecting conductors of a flat flexible circuit to the conductors of a complementary connecting device, such as a printed circuit board as shown herein. Of course, it should be understood that the system is equally applicable for use in a connector assembly for electrically interconnecting the conductors of a flat flexible circuit to the conductors of other connecting devices, such as another flat flexible circuit or discrete electrical terminals.

With that understanding, referring to the first embodiment of FIGS. 1–10, FIG. 1 shows a first or male connector, generally designated 10, which includes a male body member 12 having a leading edge 14 about which a flat flexible circuit, generally designated 16 (FIG. 2), is wrapped. A plurality of equally spaced recesses 18 are formed in the male body member at edge 14. Substantially the entire male body member may be molded of plastic material, and a pair of locating posts 20 are molded integrally therewith and project upwardly therefrom. A backing strip 22 spans substantially the entire width of the male body member and also projects upwardly therefrom. Lastly, a pair of latch arms 24 are formed on opposite sides of the male body member.

Figure 2:
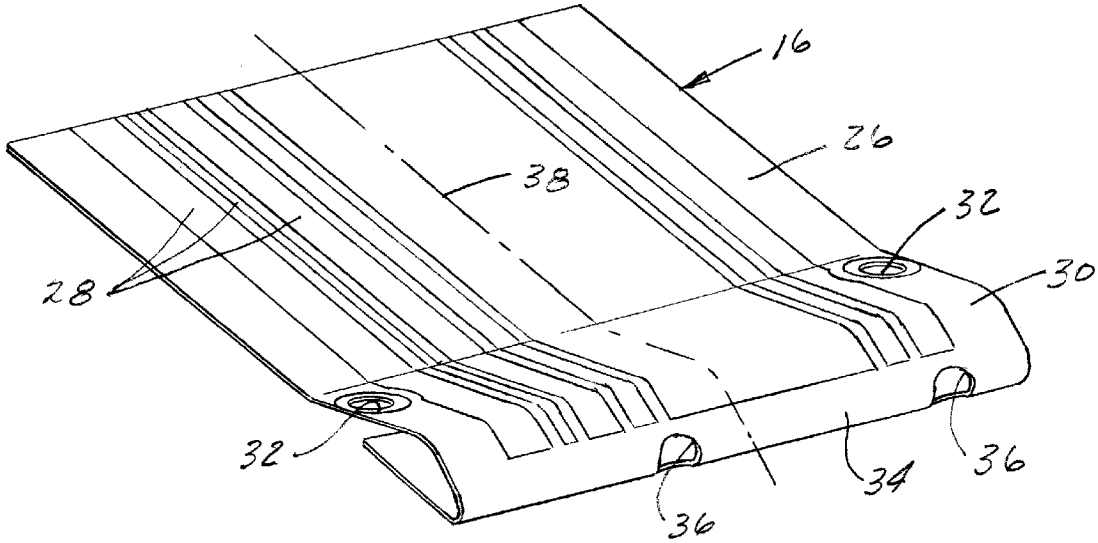
FIG. 2 is a perspective view of a keyed flat flexible circuit for wrapping about the male connector of FIG. 1.

Referring to FIG. 2, flat flexible circuit 16 is conventional to the extent that it includes an elongated flat flexible dielectric substrate 26 having laterally spaced strips of conductors 28 thereon. The conductors may be covered with a thin, flexible protective layer on one or both sides of the circuit. If the top side of circuit 16 has a protective layer, the layer is cut-out in a contact area 30 which spans the width of the circuit. A pair of locating holes 32 are formed in the circuit through the substrate thereof. As seen in FIG. 2, the circuit is bent or formed so that it can be wrapped about leading edge 14 (FIG. 1) of male body member 12 of male connector 10. This forms a leading wrapped area 34 (FIG. 2) across the width of the circuit. Finally, a pattern of keying holes 36 is provided in wrapped area 34 of the circuit. The holes may be in an asymmetrical pattern to the extent that they are asymmetrically spaced on opposite sides of a longitudinal center-line 38 of the flat flexible circuit.

Figure 3:
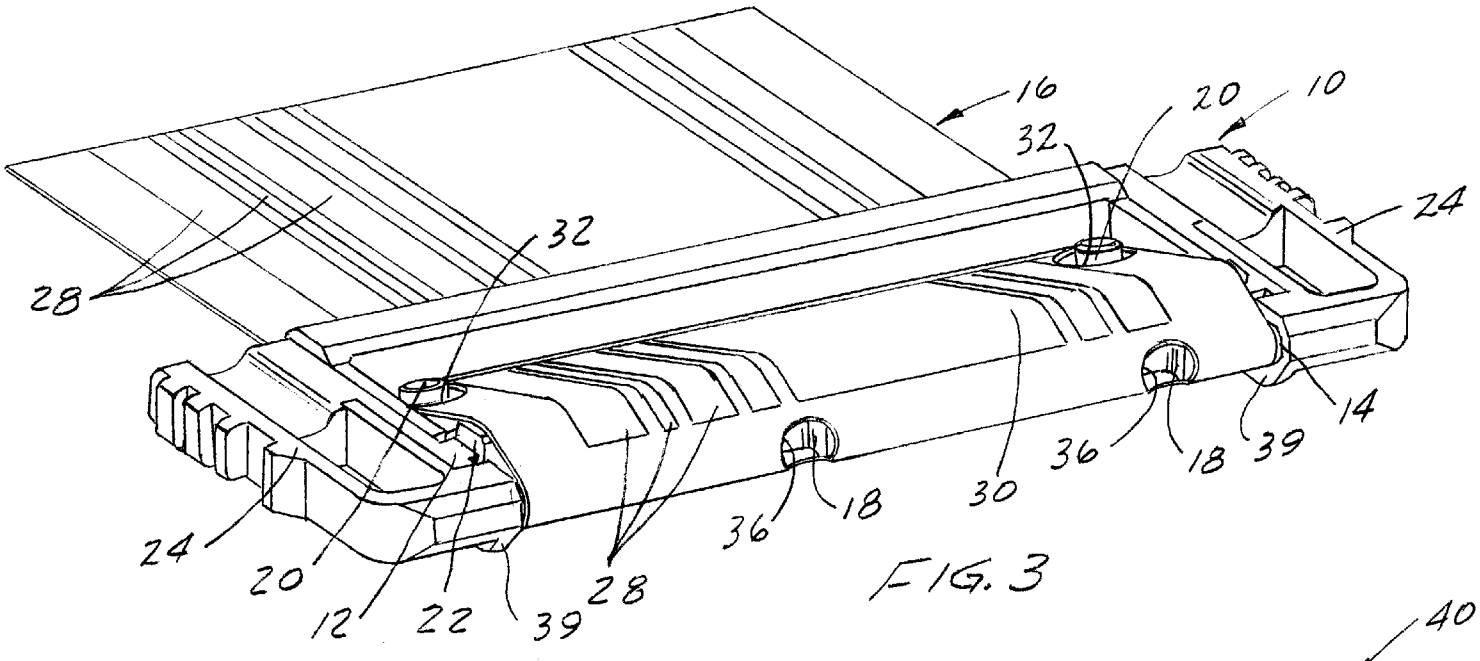
FIG. 3 is a perspective view of the circuit of FIG. 2 wrapped about the male connector of FIG. 1.

FIG. 3 shows flat flexible circuit 16 wrapped about leading edge 14 of male body member 12 of male connector 10. It can be seen that locating posts 20 of the male body member project through locating holes 32 of the circuit. Contact area 30 which exposes conductors 28 is located along the top of backing strip 22 so that the exposed conductors project upwardly of the assembly. Keying holes 36 in the circuit are aligned with two of the recesses 18 in leading edge 14 of the male body member. FIG. 3 shows that male body member 12 has a pair of polarizing ribs 39 on the bottom thereof.

In comparing male body member 12 of FIG. 1 to flat flexible circuit 16 of FIG. 2, it can be seen that recesses 18 in the leading edge of the male body member are equally spaced and generally symmetrical, while keying holes 36 in the flat flexible circuit are in an asymmetrical pattern relative to center-line 38 of the circuit. Nevertheless, the two keying holes are aligned with two of the recesses. It can be understood that a considerable number of patterns of keying holes 36 ranging from a single hole to four holes can be formed in the flat flexible circuit using only four recesses 18 in the male body member. Of course, the invention contemplates that more than four recesses 18 can be provided to afford a larger number of combinations of keying holes 36 in a considerable number of asymmetrical patterns of holes.

Figure 4:
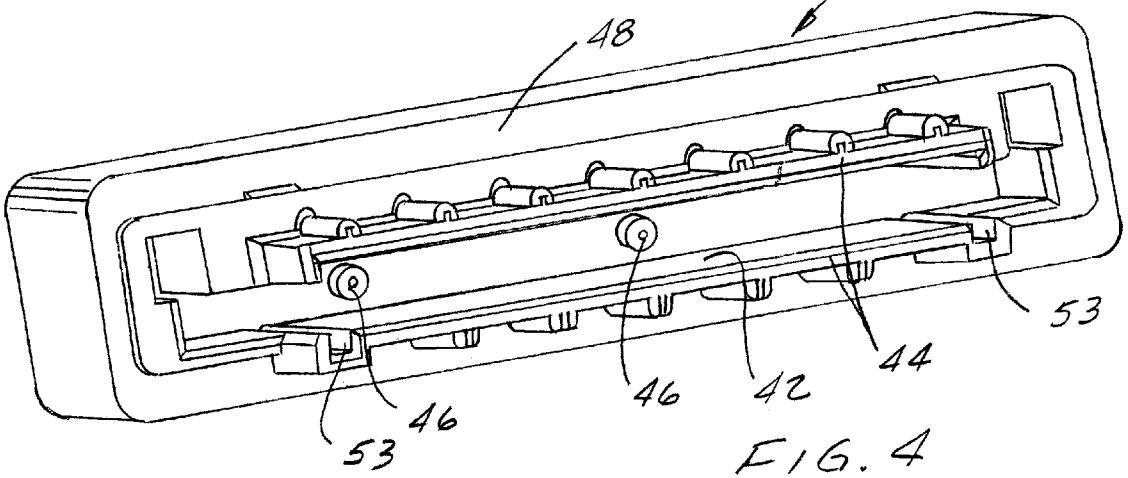
FIG. 4 is a perspective view of the mating face of a female connector for receiving the male connector and circuit of FIG. 3.
Figures 5, 6:
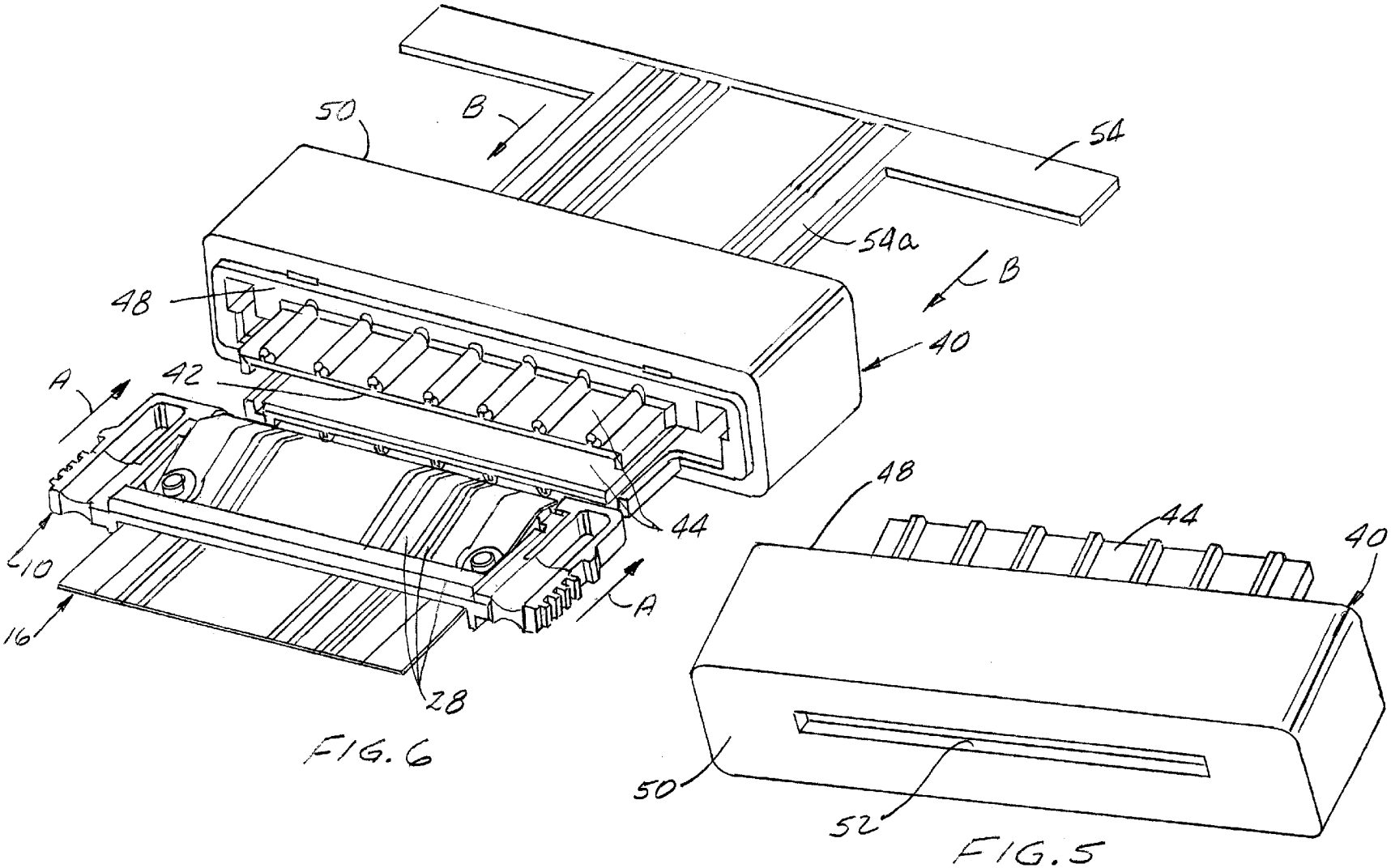
FIG. 5 is a rear perspective view of the female connector shown in FIG. 4.
FIG. 6 is a perspective view of the entire connector assembly of the first embodiment, in exploded condition.

FIGS. 4 and 5 show a second or female connector, generally designated 40, for mating with male connector 10 (FIGS. 1 and 3). Specifically, female connector 40 includes a receptacle 42 (FIG. 4) formed between a pair of walls 44 for receiving leading edge 14 of male connector 10 with flat flexible circuit 16 wrapped thereabout. As best seen in FIG. 4, a pair of keying projections 46 are formed in receptacle 42 at the base thereof. These keying projections are in a pattern corresponding to the pattern of keying holes 36 (FIG. 2) in the flat flexible circuit. While FIG. 4 shows a front mating face 48 of the female connector, FIG. 5 shows a rear terminating face 50 of the connector wherein an elongated slot 52 is formed for receiving a printed circuit board as will be seen below. FIG. 4 also shows that the female connector has a pair of polarizing slots 53 for receiving polarizing ribs 39 of male connector 10 to prevent the male connector from being inserted into receptacle 42 upside down.

Figure 7:
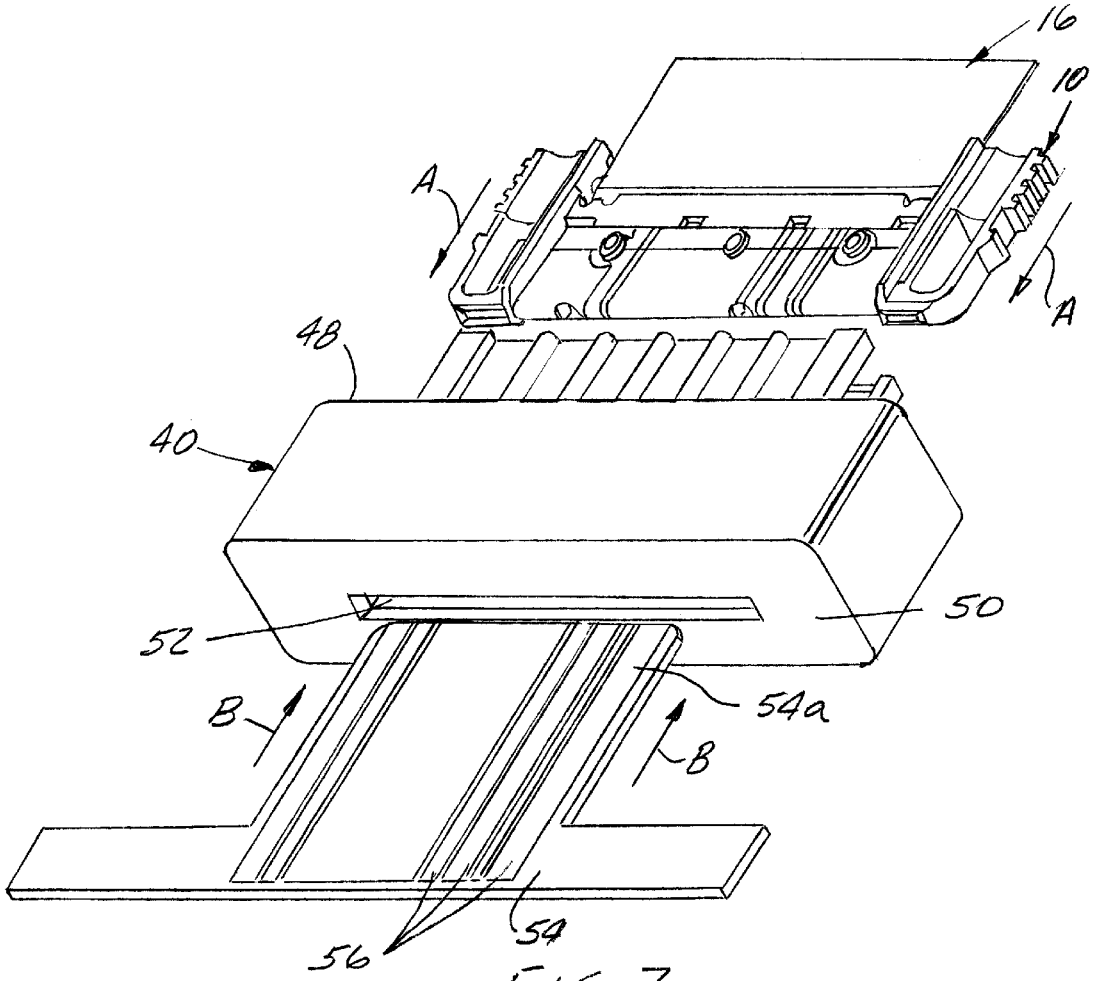
FIG. 7 is a perspective view of the assembly of FIG. 6, looking in the opposite direction.

FIGS. 6 and 7 show the entire assembly of male connector 10, flat flexible circuit 16, female connector 40 and a printed circuit board 54 in unassembled condition. The subassembly of male connector 10 and flat flexible circuit 16 are inserted into receptacle 42 of female connector 40 in the direction of arrows "A". Printed circuit board 54 has a tongue portion **54*a* which is insertable into slot 52 (FIG. 7) in rear terminating face 50 of female connector 40 in the direction of arrows "B". It can be seen in FIG. 7 that printed circuit board 54 has a plurality of conductors 56 for interconnection to conductors 28 (FIG. 6**) of the flat flexible circuit.

Figure 8:
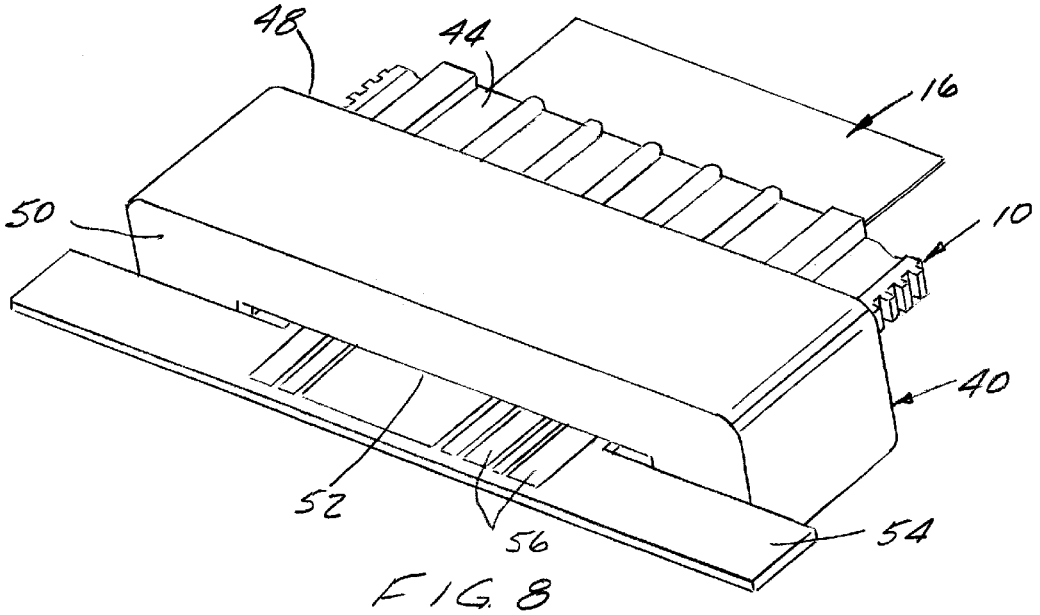
FIG. 8 is a perspective view of the assembly as viewed in FIG. 6, in assembled and mated condition.
Figure 9:
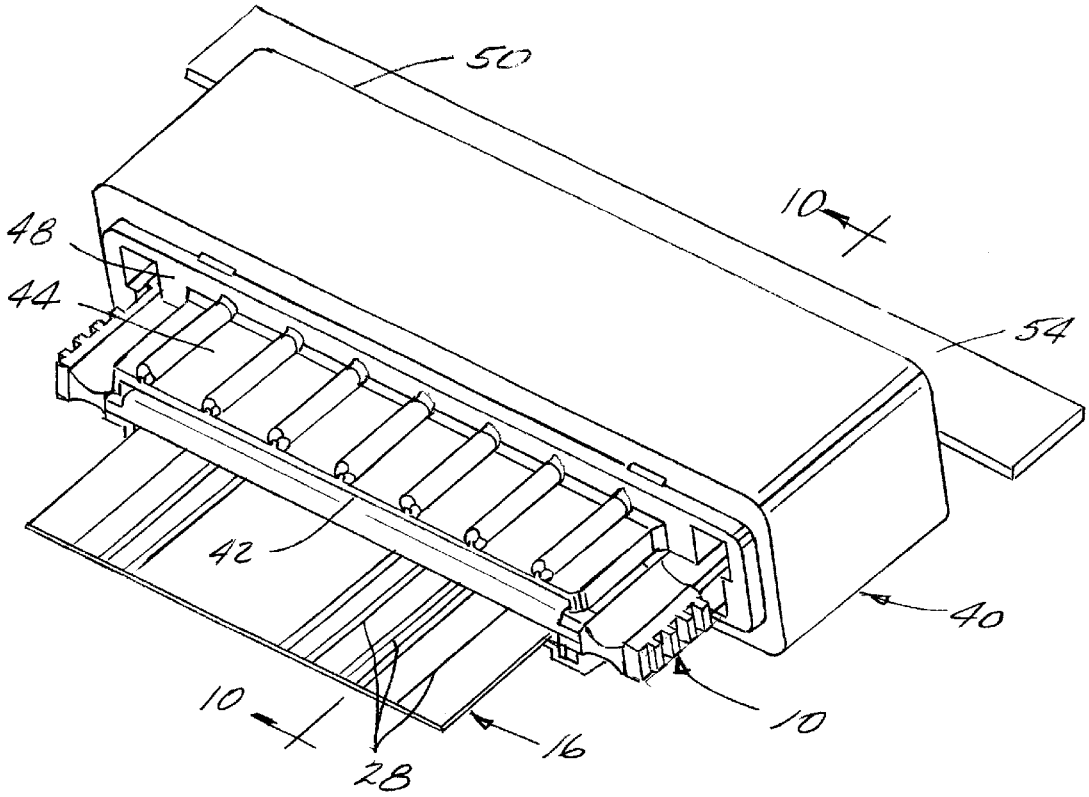
FIG. 9 is a view of the assembly of FIG. 8, looking in the opposite direction.
Figure 10:
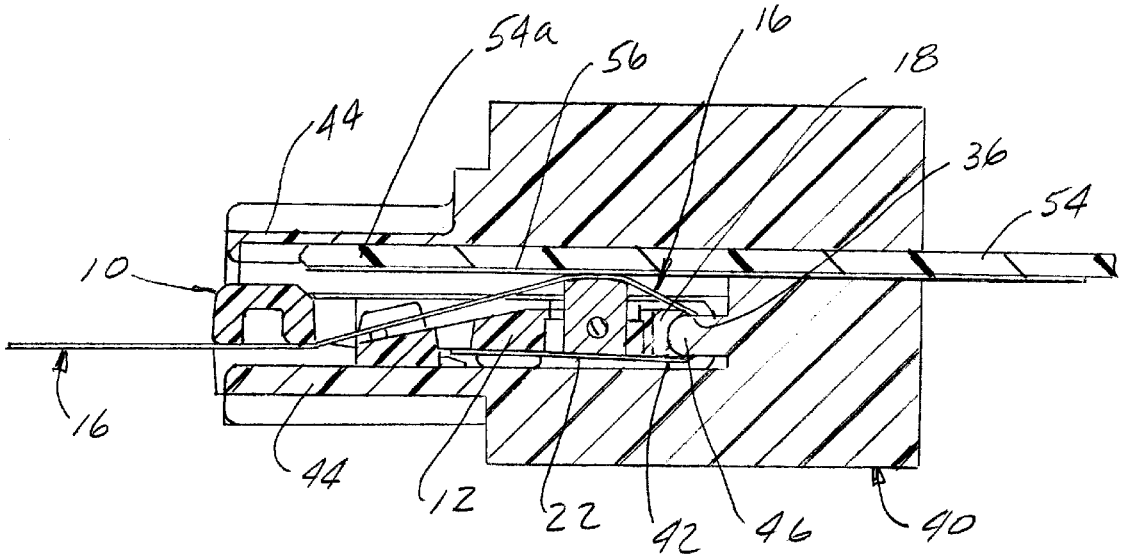
FIG. 10 is a vertical section taken generally along line 10—10 of FIG. 9.

FIGS. 8 and 9 show male connector 10 and printed circuit board 54 fully inserted into opposite sides of female connector 40 to electrically interconnect conductors 56 (FIG. 8) of the printed circuit board with conductors 28 (FIG. 9) of flat flexible circuit 16. As best seen in FIG. 10, backing strip 22 on male body member 12 of male connector 10 biases flat flexible circuit 16 against conductors 56 on the bottom of tongue portion **54*a* of printed circuit board 54. As described in relation to FIG. 2, the conductors of the flat flexible circuit are exposed in contact area 30 (FIG. 2) which is located directly on top of backing strip 22 so that the exposed conductors in the contact area engage conductors 56** of the printed circuit board.

FIG. 10 further shows one of the keying projections 46 at the base of receptacle 42 of female connector 40, inserted through one of the keying holes 36 in flat flexible circuit 16. It can be seen that keying projection 46 extends completely through the circuit and into one of the recesses 18 at the leading edge of male body member 12 of the male connector 10.

From the foregoing, it can be understood that male connector 10 cannot be fully mated with female connector 40 unless the pattern of keying holes 36 in flat flexible circuit 16 matches the pattern of keying projections 46 within receptacle 42 of female connector 40. If the patterns of keying holes and keying projections do not match, the unmatched keying projection(s) will abut against the wrapped area of the flat flexible circuit which does not have any keying hole(s), and the connectors cannot be mated. In essence, the invention utilizes the flat flexible circuit, itself, as a keying component of the connector assembly. It is quite inexpensive to vary the pattern of keying holes in the flat flexible circuit as the circuits typically are custom configured for each application anyway. In this manner, a standard male connector (FIG. 1) can be fabricated with uniformly spaced recesses 18 and used with any number of differently keyed assemblies. In other words, male connector 10 does not in any way have to be changed to change the keyed arrangement of the overall connector assembly. This saves considerable expenses in not having to change a major component of the assembly every time a different "key" is employed.

FIGS. 11–18 show a second embodiment of the invention, and like reference numerals have been applied in FIGS. 11–18 corresponding to like components described above in relation to the first embodiment of FIGS. 1–10. This should provide a more concise and clear understanding of the invention in comparing the two embodiments.

Figure 11:
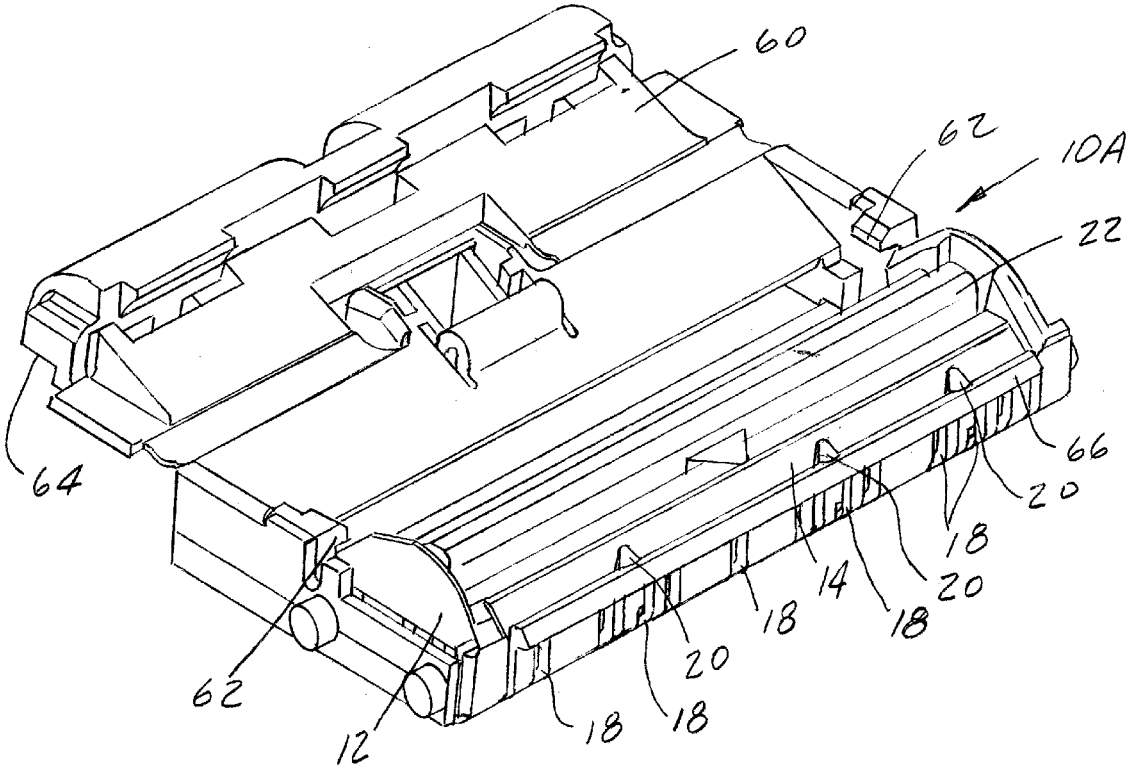
FIG. 11 is a perspective view looking at the mating end of a male connector of a connector assembly according to a second embodiment of the invention.
Figure 12:
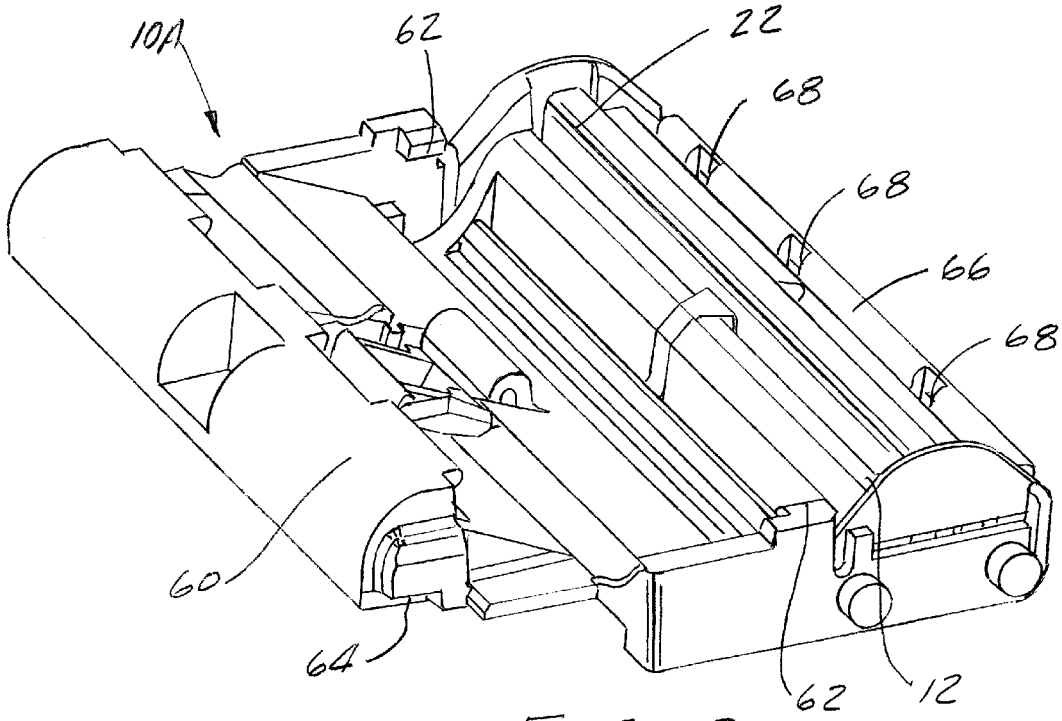
FIG. 12 is a perspective view looking at the back side of the connector of FIG. 11.

With that understanding, FIGS. 11 and 12 show a male connector, generally designated 10A, having a male body member 12 with a leading edge 14, a plurality of recesses 18 in the leading edge, a plurality of locating posts 20 and a backing strip 22, all for purposes described above in relation to the same components of male connector 10 in FIG. 1. Male connector 10A in FIGS. 11 and 12 also includes a cover 60 for clamping a flat flexible circuit to the male body member. Latches 62 are provided on the male body member for engaging latch shoulders 64 on the cover to hold the cover down on the male body member clamping the flexible circuit therebetween. Lastly, leading edge 14 of male body member 12 of male connector 10A is formed with a lip 66 within which recesses 18 (FIG. 11) are formed. As will be seen hereinafter, a leading edge of the flat flexible circuit is inserted behind lip 66, and a plurality of slots 68 (FIG. 12) are formed in the back side of the lip in line with locating posts 20 (FIG. 11) so that the leading edge of the flat flexible circuit can be forced behind the lip.

Figure 13:
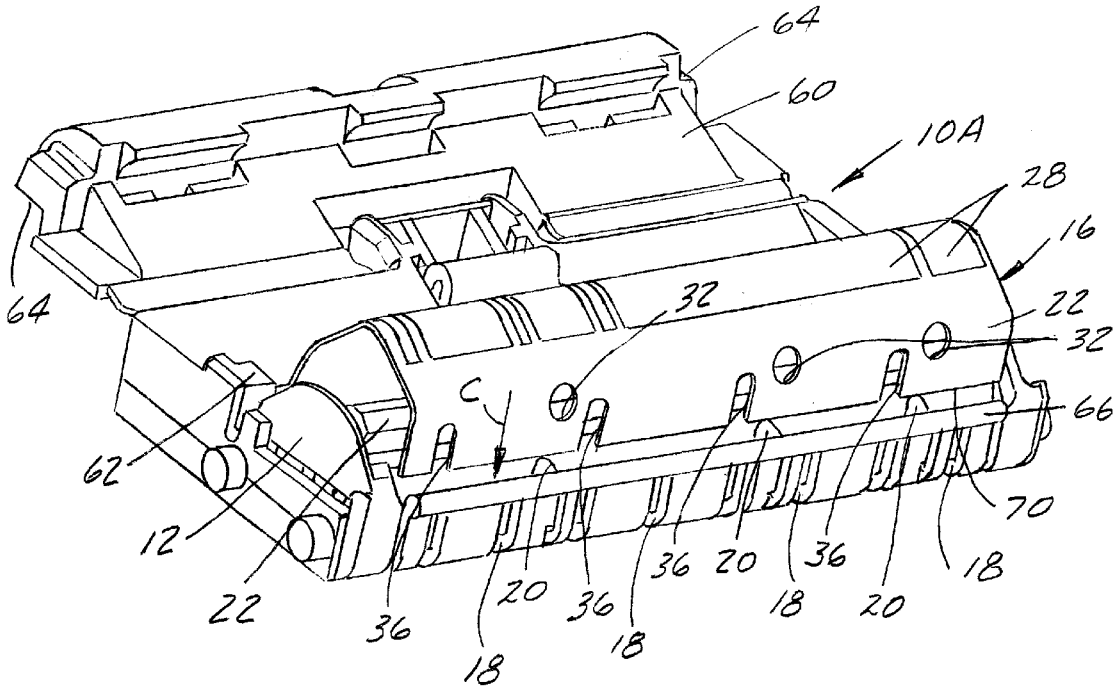
FIG. 13 is a perspective view similar to that of FIG. 11, with a keyed flat flexible circuit being positioned on the connector.

FIG. 13 shows a flat flexible circuit 16 including an elongated flat flexible dielectric substrate 26 having laterally spaced conductor strips 28 thereon. A plurality of located holes 32 embrace locating posts 20 of male body member 12. The invention in the second embodiment includes a pattern of keying holes 36 formed adjacent the leading edge of the flat flexible circuit. Actually, in the second embodiment of FIGS. 11–18, the keying holes are in the form of notches 36 cut into a leading edge 70 of the flat flexible circuit. The pattern of keying holes or notches may be asymmetrical relative to a longitudinal center-line 38 of the flat flexible circuit. When leading edge 70 of flat flexible circuit 16 is inserted behind lip 66 of male body member 12 in the direction of arrow "C", locating holes 32 in the circuit engage about locating posts 20 on the male body member. In addition, keying holes or notches 36 become aligned with certain ones of recesses 18 formed through the lip.

Figure 14:
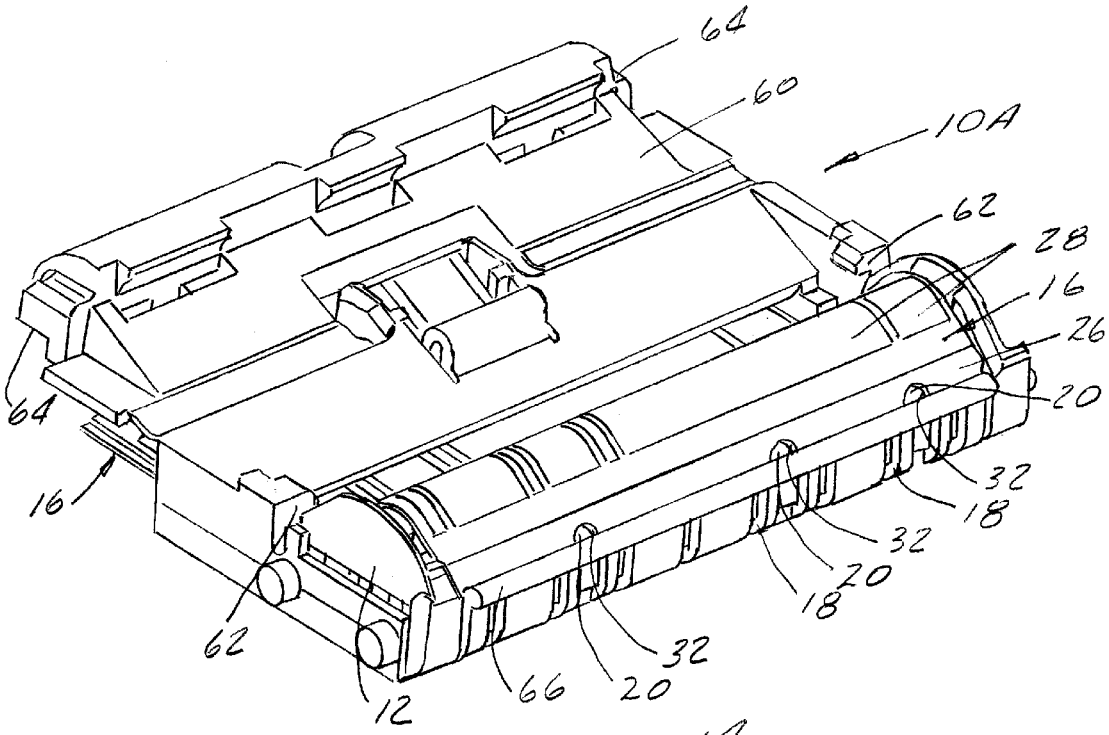
FIG. 14 is a view similar to that of FIG. 13, with the flat flexible circuit fully positioned on the connector.
Figure 15:
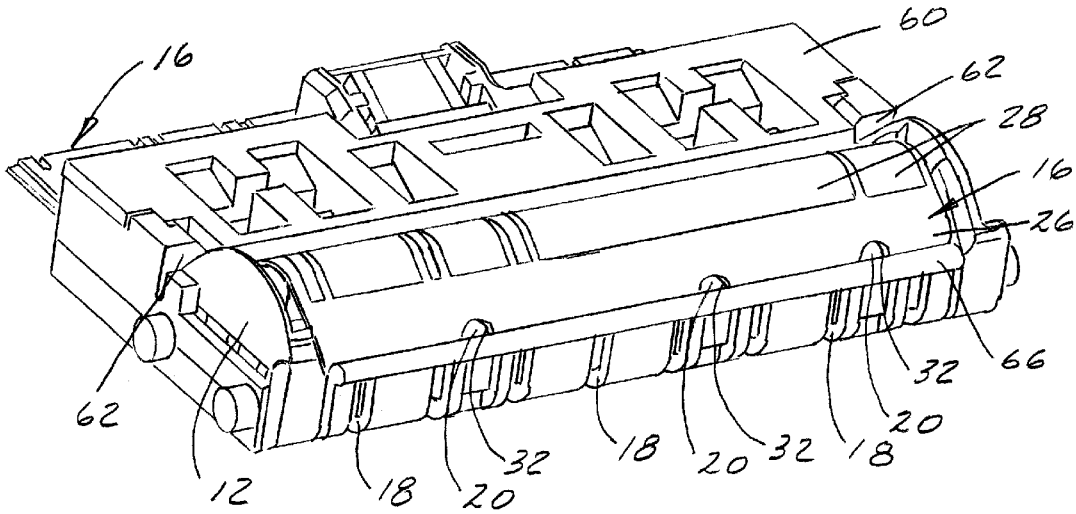
FIG. 15 is a view similar to that of FIG. 14, but with the cover of the connector in closed condition.

FIG. 14 shows flat flexible circuit 16 fully inserted into male body member 12 of male connector 10A. Cover 60 then is rotated to a closed position as shown in FIG. 15 to engage latches 62. This subassembly of male connector 10A and flat flexible circuit 16 then is mateable with a female connector 40A (FIG. 16) in the direction of arrows "D". The female connector has a latch 74 which engages a latch structure 76 to hold the male and female connectors in assembly. The male connector is inserted into a receptacle 42 of the female connector. FIG. 17 shows the male connector inserted further into the receptacle but not yet in fully mated condition.

Figure 16:
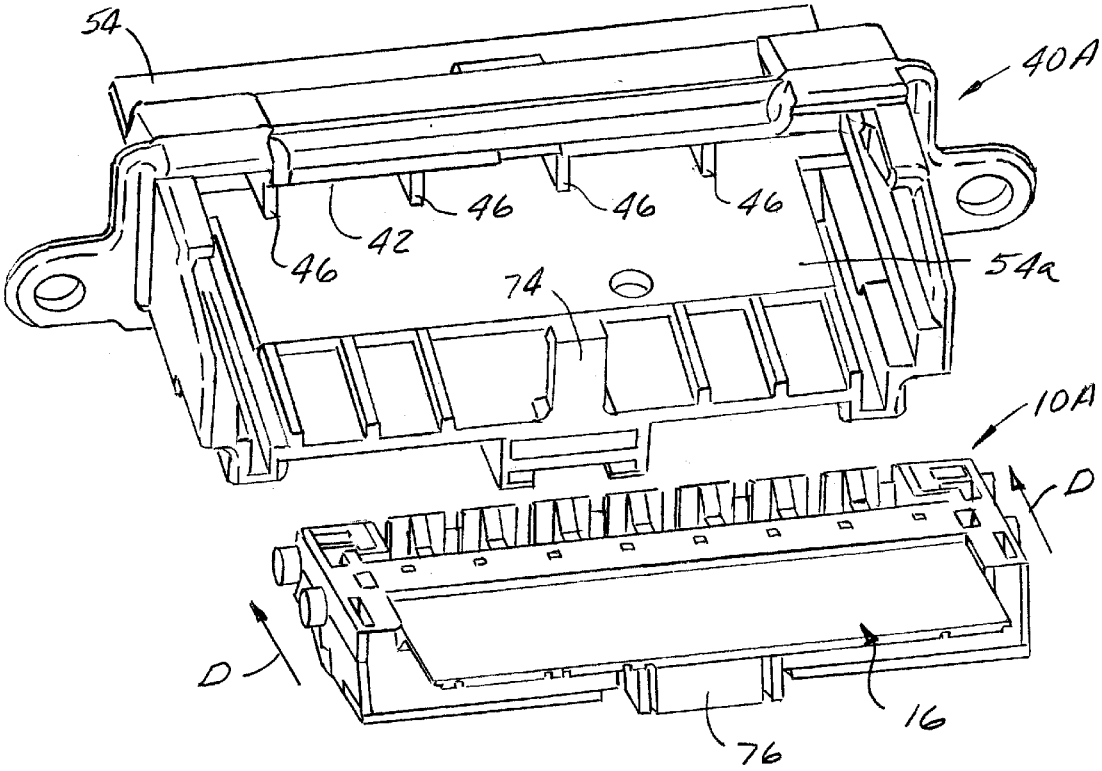
FIG. 16 is a perspective view of the male connector of FIGS, 11–15 about to be inserted into a keyed female connector.
Figure 17:
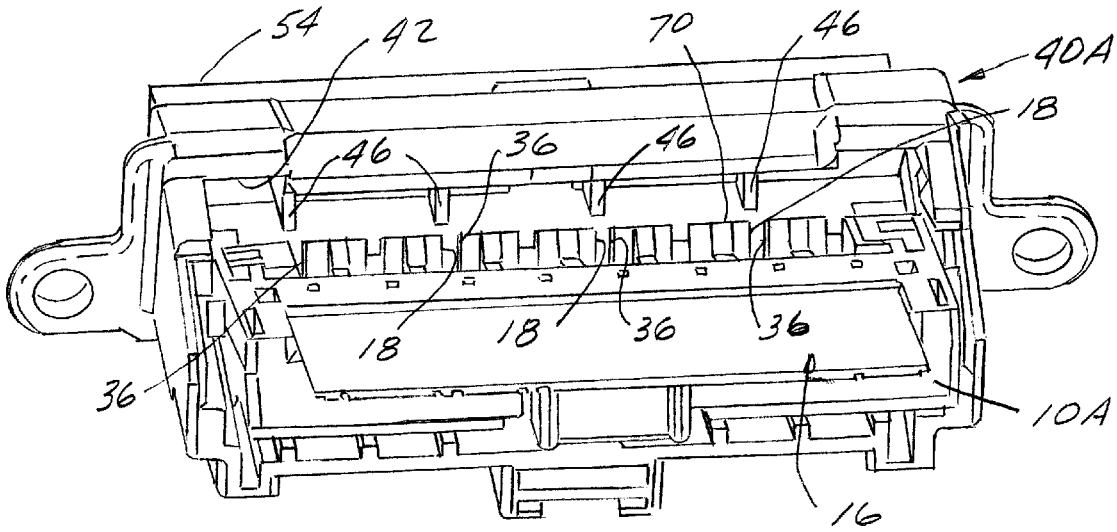
FIG. 17 is a view similar to that of FIG. 16, with the male connector inserted into the female connector.
Figure 18:
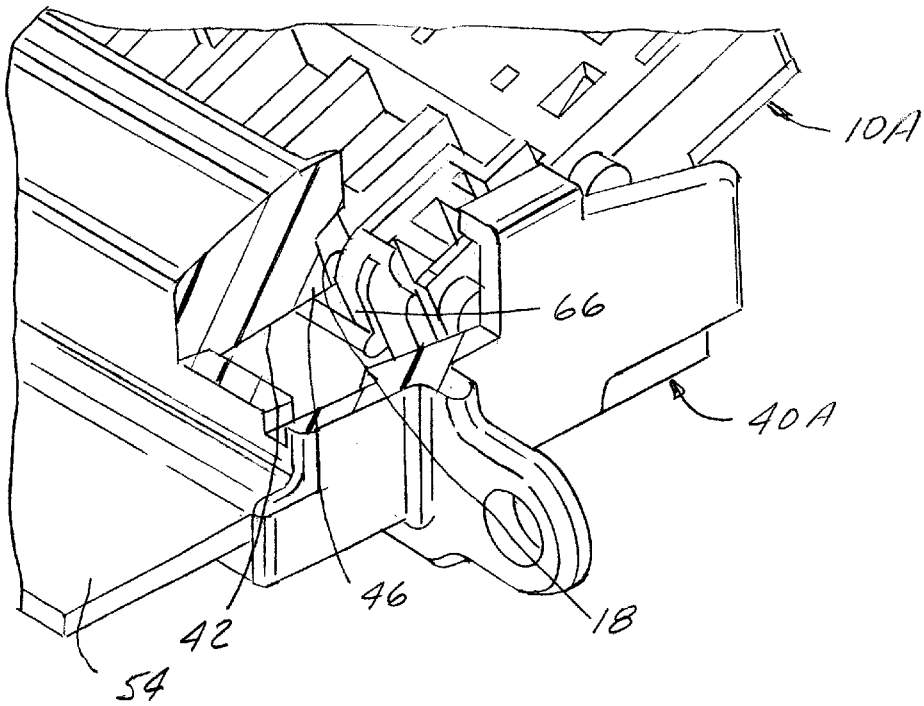
FIG. 18 is a fragmented, enlarged perspective view, partially in section, showing the keying area of the connector assembly of FIGS. 16 and 17.

In referring to FIGS. 16 and 17, it should be understood that male connector 10A is inverted or upside down in comparison to the depictions of FIGS. 11–15. With that understanding, FIGS. 16 and 17 show that female connector 40A includes a pattern of keying projections 46 generally at an entrance to receptacle 42. In comparing FIG. 17 with FIG. 13, the pattern of keying projections 46 matches the pattern of keying holes or notches 36 in leading edge 70 of flat flexible circuit 16. The notches in the circuit, in turn, are in alignment with certain ones of the recesses 18 in the male connector so that keying projections 46 can pass completely through notches 36 in the flat flexible circuit. FIG. 18 shows one of the keying projections 46 in alignment with one of the recesses 18. As with the embodiment of FIGS. 1–10, a printed circuit board 54 is inserted into the back side of female connector 40A for interconnection to the flat flexible circuit.

From the foregoing, it can be understood that, like the first embodiment of male connector 10, male connector 10A of the second embodiment can be made as a standard component with a plurality of recesses 18 typically in excess of the number of keying holes 36 in the flat flexible circuit and keying projections 46 of the female connector. Therefore, considerable costs are saved by providing a standard male connector, and simply changing the "key" of the flat flexible circuit and the female connector. The primary difference between the first embodiment of FIGS. 1–10 and the second embodiment of FIGS. 11–12 is that, in the first embodiment, keying projections 46 within female connector 40 do not engage within keying holes 36 in the flat flexible circuit until the male and female connectors are substantially entirely mated. In the embodiment of FIGS. 11–18, keying projections 46 enter keying holes or notches 36 in the flat flexible circuit and into recesses 18 in the male connector upon initial mating of the two connectors, and this can be seen in FIG. 18.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A keying system in a connector assembly for electrically interconnecting conductors of a flat flexible circuit, comprising:

a first connector having a body member for positioning the flat flexible circuit thereon, the body member having a plurality of recesses in a leading edge thereof at which the flat flexible circuit is positioned; and a second connector for mating with the first connector and including a selected pattern of one or more keying projections insertable into a corresponding pattern of keying holes in the flat flexible circuit on the first connector, the keying projections passing through the holes and into certain ones of the recesses at the leading edge of the body member of the first connector;

whereby the first connector can be unchanged as a standard component of the connector assembly with said plurality of recesses, and the pattern of keying projections on the second connector and the corresponding pattern of keying holes in the flat flexible circuit can be selectively changed to key the circuit to the connector assembly without changing the first connector.

2. The keying system of claim 1 wherein said second connector includes a receptacle for receiving the body member of the first connector, said keying projections being located at the receptacle.

3. The keying system of claim 2 wherein the body member of the first connector comprises a male body member with said leading edge being mateable in the receptacle of the second connector.

4. A keying system in a connector assembly for electrically interconnecting conductors of a flat flexible circuit, wherein the flat flexible circuit has a longitudinal center-line, comprising:

a first connector having a body member for positioning the flat flexible circuit thereon, the body member having a plurality of recesses in a leading edge thereof at which the flat flexible circuit is positioned; and a second connector for mating with the first connector and including a keying projection spaced to one side of said center-line insertable into a correspondingly located keying hole in the flat flexible circuit on the first connector, the second connector being void of a keying projection and the flat flexible circuit being void of a keying hole at the same spacing on the opposite side of the center-line;

whereby the first connector can be unchanged as a standard component of the connector assembly with said plurality of recesses, and the location of the keying projection on the second connector and the corresponding location of keying hole in the flat flexible circuit can be selectively changed to key the flat flexible circuit to the connector assembly without changing the first connector.

5. The keying system of claim 4 wherein said second connector includes a receptacle for receiving the body member of the first connector, said keying projection being located at the receptacle.

6. The keying system of claim 5 wherein the body member of the first connector comprises a male body member with said leading edge being mateable in the receptacle of the second connector.

* * * * *